United States Patent [19]

Perona

[11] 4,422,710

[45] Dec. 27, 1983

[54] REPAIRABLE BACKSHELL ADAPTER FOR ELECTRICAL CONNECTOR

[75] Inventor: Brian J. Perona, Indianapolis, Ind.

[73] Assignee: The United States of America as represented by the Secretary of the Navy, Washington, D.C.

[21] Appl. No.: 333,157

[22] Filed: Dec. 21, 1981

[51] Int. Cl.[3] ..... H01R 17/18

[52] U.S. Cl. ..... 339/177 R; 339/89 M

[58] Field of Search ..... 339/177 R, 177 E, 89 C, 339/89 R, 90 C, 94 C, 89 M, 49 R, 49 B, 103 M, 103 R

[56] References Cited

U.S. PATENT DOCUMENTS

| | | | |
|---|---|---|---|
| 2,449,983 | 9/1948 | Devol | 339/89 R |
| 2,761,110 | 8/1956 | Edlen et al. | 339/89 C |
| 2,805,399 | 9/1957 | Leeper | 333/6 |
| 3,364,457 | 1/1968 | Veith et al. | 339/177 E |
| 3,368,025 | 2/1968 | Burdett et al. | 174/75 |
| 3,609,651 | 9/1971 | Sladek et al. | 339/177 |
| 3,611,271 | 10/1971 | Knapp | 339/177 |
| 3,732,527 | 5/1973 | McNight | 339/103 M |
| 3,944,317 | 3/1976 | Oberdiear | 339/143 R |
| 3,963,321 | 6/1976 | Burger et al. | 339/177 |
| 4,126,372 | 11/1978 | Hashimoto et al. | 339/177 |
| 4,133,594 | 1/1979 | Laverick et al. | 339/95 |
| 4,229,061 | 10/1980 | Majors | 339/49 B |
| 4,249,790 | 2/1981 | Ito et al. | 339/177 |
| 4,351,036 | 9/1982 | Mollere | 339/49 R |

FOREIGN PATENT DOCUMENTS

| | | | |
|---|---|---|---|
| 1765421 | 7/1971 | Fed. Rep. of Germany | 339/177 E |

*Primary Examiner*—Eugene F. Desmond
*Assistant Examiner*—David L. Pirlot
*Attorney, Agent, or Firm*—Robert F. Beers; Paul S. Collignon

[57] ABSTRACT

A backshell adapter has a terminator which has a plurality of teeth engageable with teeth on the backshell of an electrical connector and a barrel threadedly engages threads on the backshell and holds the terminator and backshell together. The aft end of the terminator has a tapered surface and a clamping sleeve wedges a braided shield against the tapered surface.

2 Claims, 2 Drawing Figures

REPAIRABLE BACKSHELL ADAPTER FOR ELECTRICAL CONNECTOR

BACKGROUND OF THE INVENTION

The present invention relates to electrical cables having a connector on one or both ends and more particularly relates to a cable assembly which can be readily repaired in event of damage.

Heretofore, electrical connectors which were used by the military generally had a backshell adapter which was secured to a connector by setscrews and a braided wire shield, which prevented electro-magnetic interference, was terminated by electro-magnetically forming the shield between two concentric cylinders. The setscrews, however, often vibrated loose causing a defected assembly and also the setscrews damaged the connector threads. The disadvantage of electro-magnetically attaching the braided shield was that the cable could not be readily repaired as disassembly destroyed the end of the braided shield.

SUMMARY OF THE INVENTION

The present invention relates to a backshell adapter for use with a cable and electrical connector. A terminator has two segments of teeth which mate with teeth on a connector backshell and a barrel threadedly engages with threads on the connector backshell to hold the terminator and backshell together. The aft end of the terminator is provided with a tapered surface and a threaded section is provided adjacent the tapered surface. A clamping sleeve having a complementary tapered surface is positioned adjacent the tapered surface on the terminator. The end of a braided shield is positioned between the two tapered surfaces and a nut which threadedly engages with the threaded section on the terminator, wedges the two tapered surfaces together to lock the braided shield to the terminator.

It is therefore a general object of the present invention to provide an improved backshell adapter for a cable assembly which permits ready repair of the cable assembly.

Another object of the present invention is to provide an improved device for terminating a metallic cable shield.

Other objects, advantages and novel features of the present invention will become apparent from the following detailed description.

DESCRIPTION OF THE PREFERRED EMBODIMENT

Figure 1:
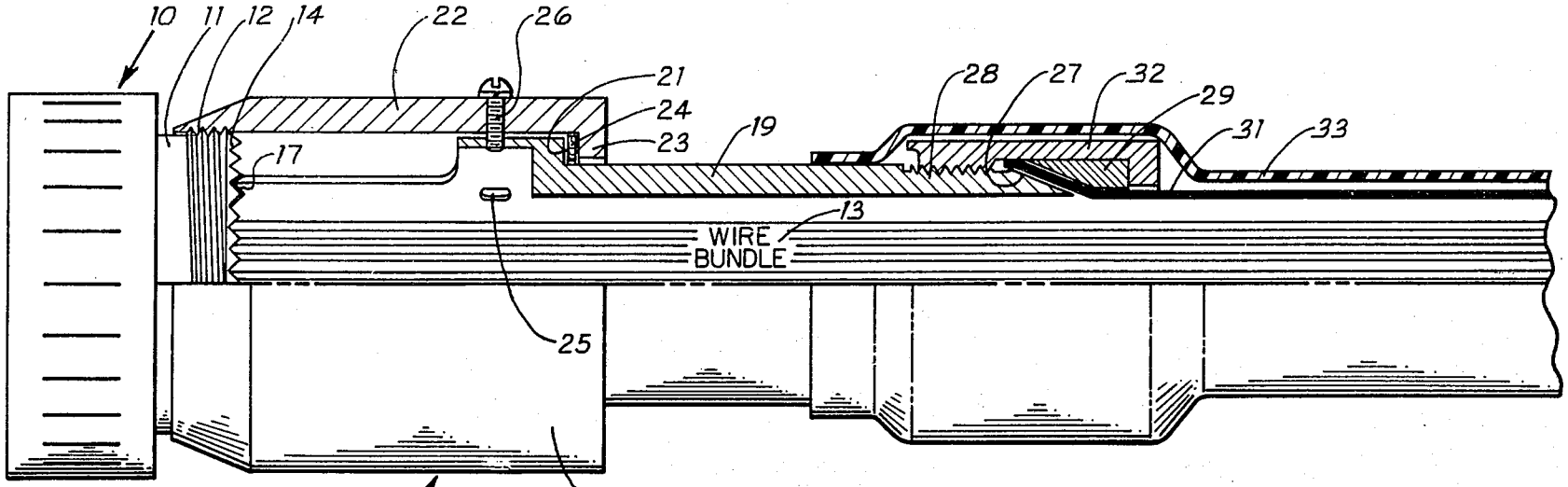
FIG. 1 is a side view, partly broken away, of a preferred embodiment.
Figure 2:
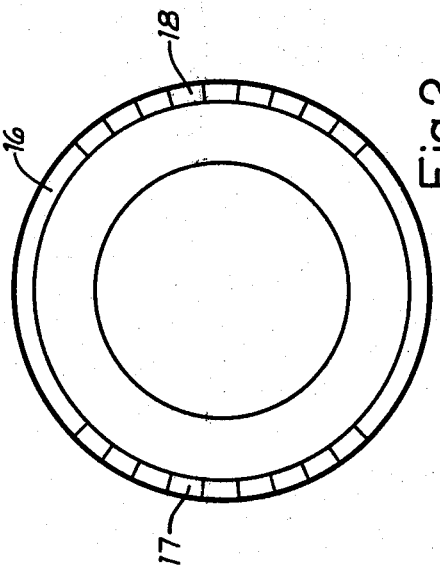
FIG. 2 is an end view of a terminator.

Referring now to the drawing, an electrical connector 10 is shown having a backshell 11 which has a threaded section 12. A plurality of wires 13 are attached to separate connector pins of connector 10. Backshell 11 is provided with a plurality of rearwardly extending teeth 14. A terminator 15 is positioned around wires 13 and has an enlarged section 16 which is provided with two segments of teeth 17 and 18 which are engageable with teeth 14 on backshell 11. A reduced diameter portion 19 adjacent enlarged section 16 of terminator 15 forms a shoulder 21, and barrel 22 threadedly engages threaded section 12. End 23 of barrel 22 engages shoulder 21 and forces engagement of teeth segments 17 and 18 with teeth 14 thereby securing terminator 15 with connector 10. A gasket 24 is provided between shoulder 21 and end 23 of barrel 22 to provide a waterproof seal. Enlarged section 16 of terminator 15 is provided with a plurality of slots 25 and a screw 26 in a threaded hole in barrel 22 is selectively engageable with slots 25. By way of example, eight slots 25 might be provided around the periphery of enlarged section 16 and be equally spaced forty-five degrees. After barrel 22 is almost fully threadedly engaged with threaded section 12, it is rotated an additional amount so that one of slots 25 can be engaged by screw 26.

The aft end of terminator 15 is provided with a tapered surface 27 and a threaded section 28 is provided adjacent surface 27. A clamping sleeve 29 has a complimentary tapered surface, and a braided metallic cable shield 31 has one end positioned between surface 27 and clamping sleeve 29. A terminator nut 32 threadedly engages section 28 and, when nut 32 is tightened, the two tapered surfaces are wedged together to clamp cable shield 31 to terminator 15. A non-metallic sleeve 33 is provided to cover nut 32 and the wire bundle extending from terminator.

The present invention provides a connector and cable assembly which is readily repairable in event of damage. Screw 26 can be disengaged from a slot 25 and then barrel 22 can be unthreaded from threaded section 12. Terminator 15 is then free to be moved away from connector 10 thereby providing access to the pins of connector 10.

It can thus be seen that the present invention provides a relatively simple backshell adapter for a cable and connector which permits repair, if needed.

Obviously many modifications and variations of the present invention are possible in the light of the above teachings. It is therefore to be understood that the invention may be practiced otherwise than as specifically described.

I claim:

1. An electrical cable assembly comprising:

an electrical connector having a backshell provided with a threaded section and a plurality of aft extending teeth thereon;

a plurality of wires extending aft from said connector through said backshell;

a terminator surrounding a portion of said wires and having at least one segment of teeth engageable with a portion of said backshell teeth, said terminator having a tapered surface on its aft end and a threaded section adjacent said tapered surface;

a barrel threadedly engageable with said threaded section on said backshell for biasing said segment of teeth on said terminator with said teeth on said backshell;

means for locking said barrel to said terminator;

a clamping sleeve adjacent said tapered surface on said terminator;

a shielded cable surrounding a portion of said wires and having one end positioned between said tapered surface and having one end positioned between said tapered surface and said clamping sleeve; and a locking nut engageable with said threaded section adjacent said tapered surface for biasing said clamping sleeve to wedge said shielded cable between said tapered surface on said terminator and said clamping sleeve.

2. An electrical cable assembly as set forth in claim 1 wherein said means for locking said barrel to said terminator comprises a plurality of slots around the periphery of said terminator and a screw in said barrel selectively engageable with said slots.

* * * * *